US005351379A

United States Patent [19]

Chu

[11] Patent Number: 5,351,379

[45] Date of Patent: Oct. 4, 1994

[54] RIVETER FOR EFFICIENTLY RIVETING AND DRAFTING SETTING MANDRELS AND SCRAPS

[76] Inventor: Eric Chu, c/o Hung Hsing Patent Service Center, P.O. Box 55-1670, Taipei (10477), Taiwan

[21] Appl. No.: 93,750

[22] Filed: Jul. 20, 1993

[51] Int. Cl.[5] ..... B21J 15/22

[52] U.S. Cl. ..... 29/243.525; 29/243.530

[58] Field of Search ..... 227/55; 29/243.521–243.529, 243.53

[56] References Cited

U.S. PATENT DOCUMENTS

| | | | |
|---|---|---|---|
| 3,451,248 | 6/1969 | Bell | 29/243.523 |
| 3,523,441 | 8/1970 | Bell et al. | 29/243.523 |
| 3,630,067 | 12/1971 | Henshaw | 29/243.524 |
| 4,275,583 | 6/1981 | Gilbert et al. | 29/243.525 |
| 4,281,531 | 8/1981 | Ehmann et al. | 29/243.525 |
| 4,704,888 | 11/1987 | Frearson | 29/243.525 |
| 4,888,974 | 12/1989 | Mandell | 29/243.523 |

*Primary Examiner*—Scott A. Smith

[57] ABSTRACT

A riveter includes a suction device mounted on a rear portion of a rivet pulling head portion capable of exerting a Venturi effect when applying a compressed air stream in the suction device for automatically drafting any mandrel broken off from a set rivet, and a plurality of radial apertures radially formed through the jaws clamping the ratchet mandrel for purging any scraps or burrs produced by the mandrel clamped and pulled by the riveter for cleanliness of the jaws for preventing malfunction of the jaws.

5 Claims, 5 Drawing Sheets

RIVETER FOR EFFICIENTLY RIVETING AND DRAFTING SETTING MANDRELS AND SCRAPS

BACKGROUND OF THE INVENTION

A conventional pneumatic-hydraulic riveter as shown in FIG. 1 includes an air cylinder A formed on a bottom portion of the riveter, a hydraulic section H secured to an upper portion of the air cylinder A, and a rivet pulling gun P formed on a top portion of the hydraulic section, whereby upon a triggering of the trigger T to open a compressed air inlet to drive a piston in the air cylinder A to drive a hydraulic plunger in the hydraulic section H to set a rivet onto a fastening object as retained on the jaws J held in the rivet-pulling gun P. However, after the rivet is set, the mandrel broken off from the rivet should be further removed from the gun P such as by inclinedly gravitationally drawing the spent mandrel downwardly rearwardly to be collected in the disposal collector D.

Hence, the conventional riveter has the following drawbacks:

1. The spent mandrel as broken off from the setting rivet is drawn by its gravity along the rearwardly sloping central through hole C in the gun P. The gun should be tilted to draw the mandrel outwardly to thereby reduce the setting rate for a riveting job.

2. The repeated clamping operations of rivet by the jaws J may produce burrs or scraps which will be accumulated on the jaw teeth, easily causing malfunction of the jaws (such as a poor clamping or sliding of rivet by the jaws) and requiring frequent maintenance jobs to clean the jaws.

3. In order to hold the rivet on a nosepiece (having jaws J therein) of the gun P, two hands should be simultaneously used to grasp the gun and hold the rivet, causing operation inconvenience.

It is therefore expected to invent a riveter through which a mandrel after setting will be automatically drawn outwardly and the burrs produced as clamped by the jaws will be purged or flushed for cleanliness.

SUMMARY OF THE INVENTION

The object of the present invention is to provide a riveter including a suction device mounted on a rear portion of a rivet pulling head portion capable of exerting a Venturi effect when applying a compressed air stream in the suction device for automatically drafting any broken mandrel from a set rivet, and a plurality of radial apertures radially formed through the jaws clamping the ratchet mandrel for purging any scraps or burrs produced by the mandrel clamped and pulled by the riveter for cleanliness of the jaws for preventing malfunction of the jaws.

DETAILED DESCRIPTION

Figure 1:
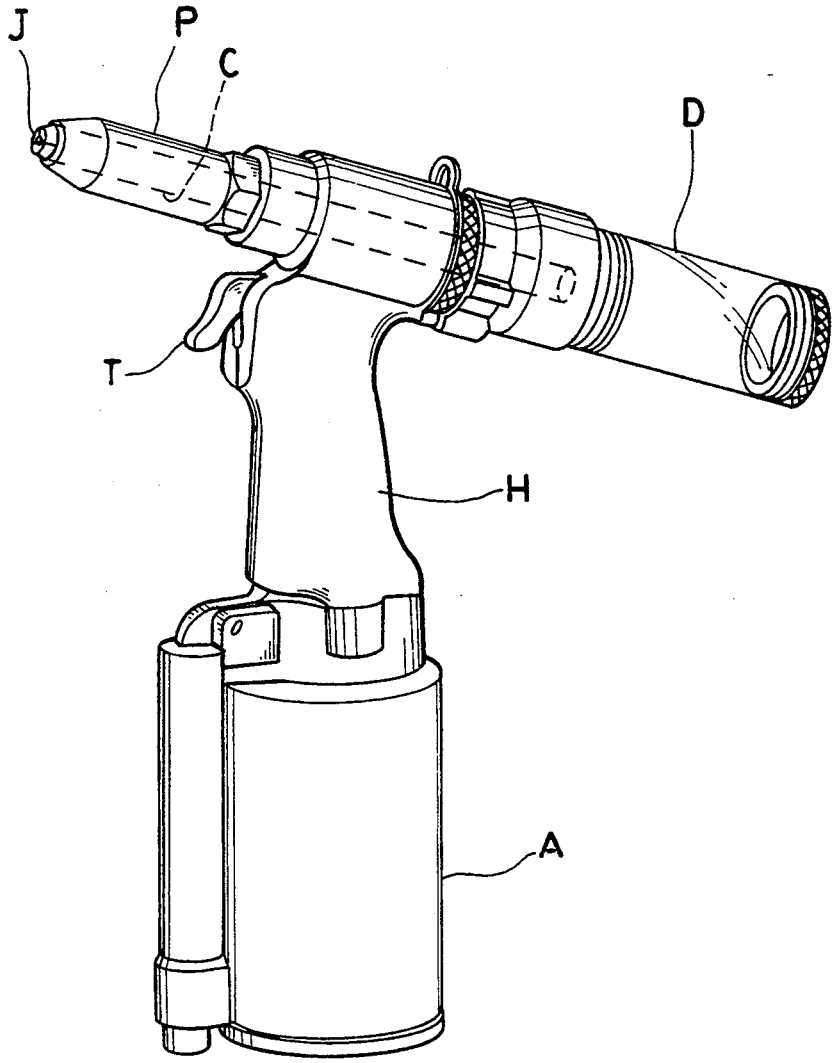
FIG.1 PRIOR ART
FIG. 1 shows a prior art of a conventional riveter.

As shown in FIGS. 2–7, the present invention comprises: a pneumatic body 1, a hydraulic body 2, a pulling head portion 3, and a suction means 4.

The pneumatic body 1 includes: a pneumatic cylinder 11 having a pneumatic piston 12 secured on a vertical plunger rod 13 reciprocatively held in the pneumatic cylinder 11, an air valve 10 formed on the cylinder 11 having a lever 14 operatively depressing a valve stem 15 provided with central hole 151 and venting hole 152, a valve plug 16 tensioned by a plug spring 161 for closing or opening a valve seat 162 between a compressed air inlet 17 and an inlet air passage 111 for on-off control of compressed air into the pneumatic cylinder 11 through the passage 111.

The hydraulic body 2 includes: a handle portion 21 secured on an upper portion of the pneumatic cylinder 11 and defining a first hydraulic oil chamber 211 longitudinally formed in the handle portion 21 communicating with a second hydraulic oil chamber 221 defined in a turret hydraulic cylinder 22 slightly inclinedly formed on a top portion of the handle portion 21 for operatively compressing a hydraulic oil in the chambers 211, 221 as urged by the plunger rod 13 and the piston 12 when boosted by compressed air, an upper plunger rod 23 secured with a plunger 24 which is rearwardly connected with a rear rod 25 and reciprocatively held in the second hydraulic oil chamber 221, and a plunger restoring spring 26 normally tensioning the plunger 24 frontwardly.

The upper plunger rod 23 has a front rod portion 232 protruding frontwardly through a front cylinder wall 223 to be connected with a coupler 35 of the pulling head portion 3. All the moving parts, such as the plunger 24, the plunger rod 23 and the rear rod 25 are respectively provided with O-rings 241, 231, 251 in the relative contact surfaces such as in the cylinder wall 223, on the surface of the chamber 221, or in a central tube hole of a front guide tube 41 of the suction means 4 for well sealing of the moving parts.

Figure 7:
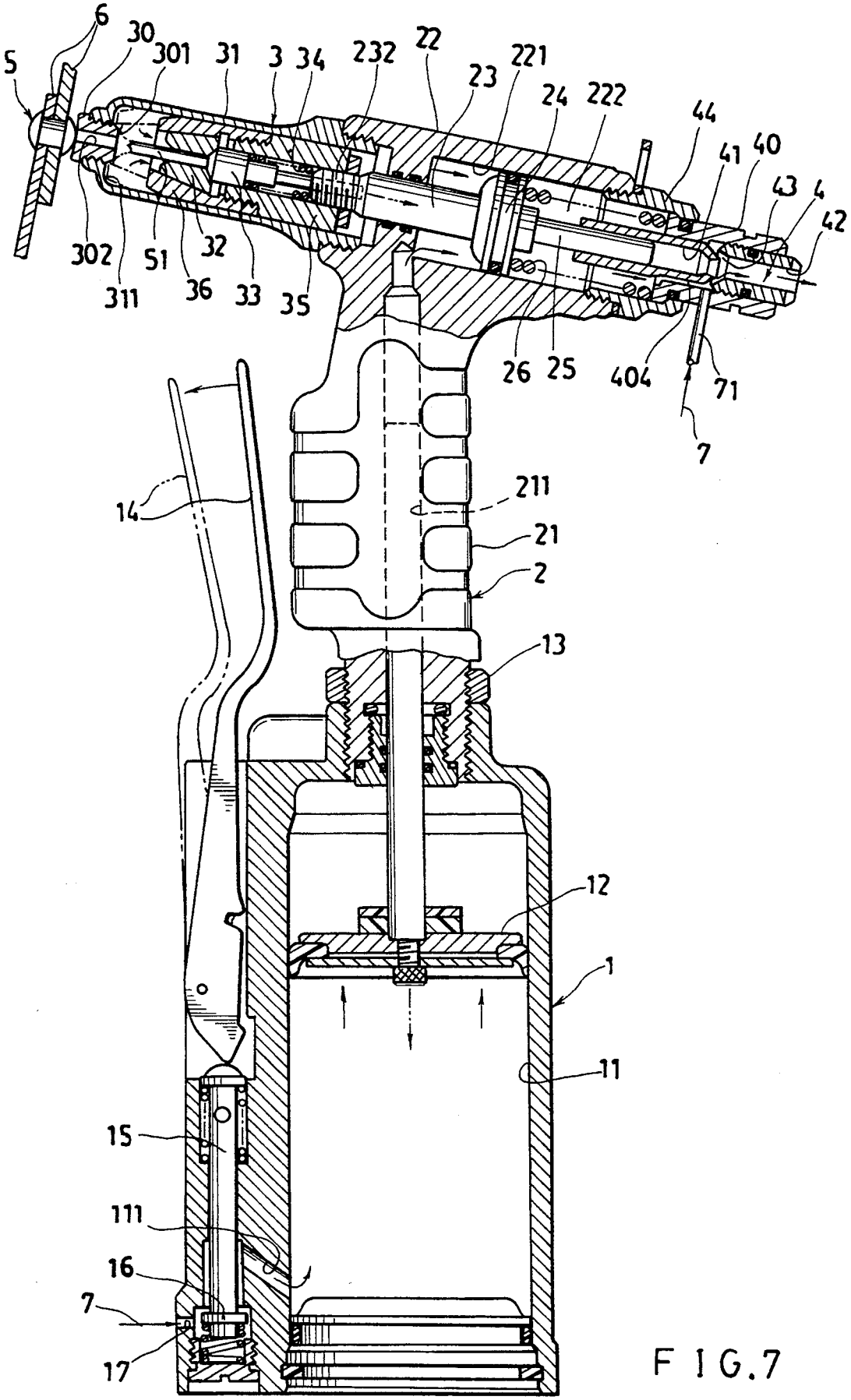
FIG. 7 is an illustration showing a rivet setting and mandrel drawing operation in accordance with the present invention.

The upper plunger rod 23, the plunger 24, and the rear rod 25 are each formed with a central hole 230, 240 and 250 through the rod 23, the plunger 24 and the rod 25 for rearwardly drafting mandrel 51 cut from a rivet 5 as shown in FIG. 7.

Figure 2:
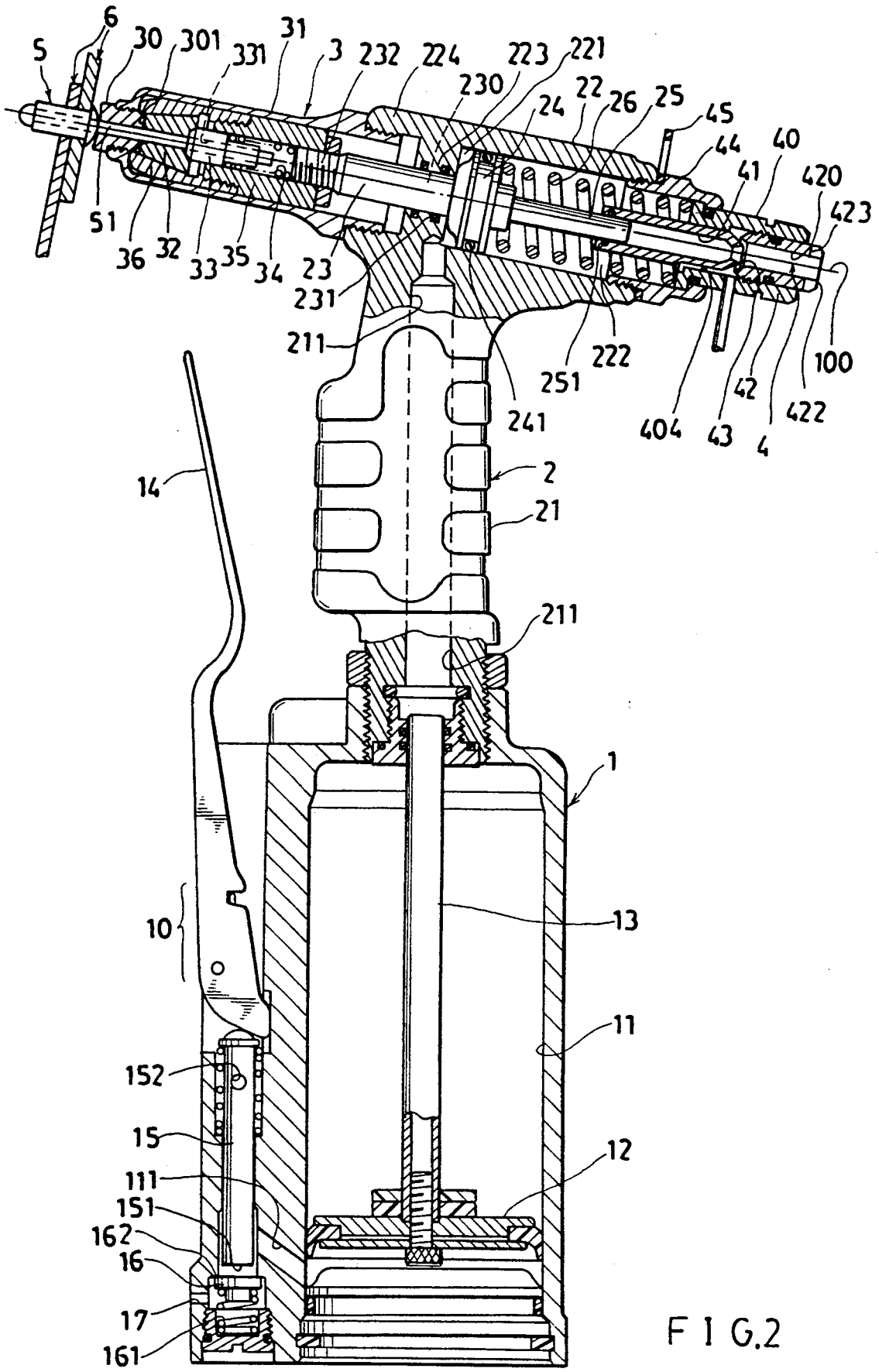
FIG. 2 is a sectional drawing of the present invention.
Figure 3:
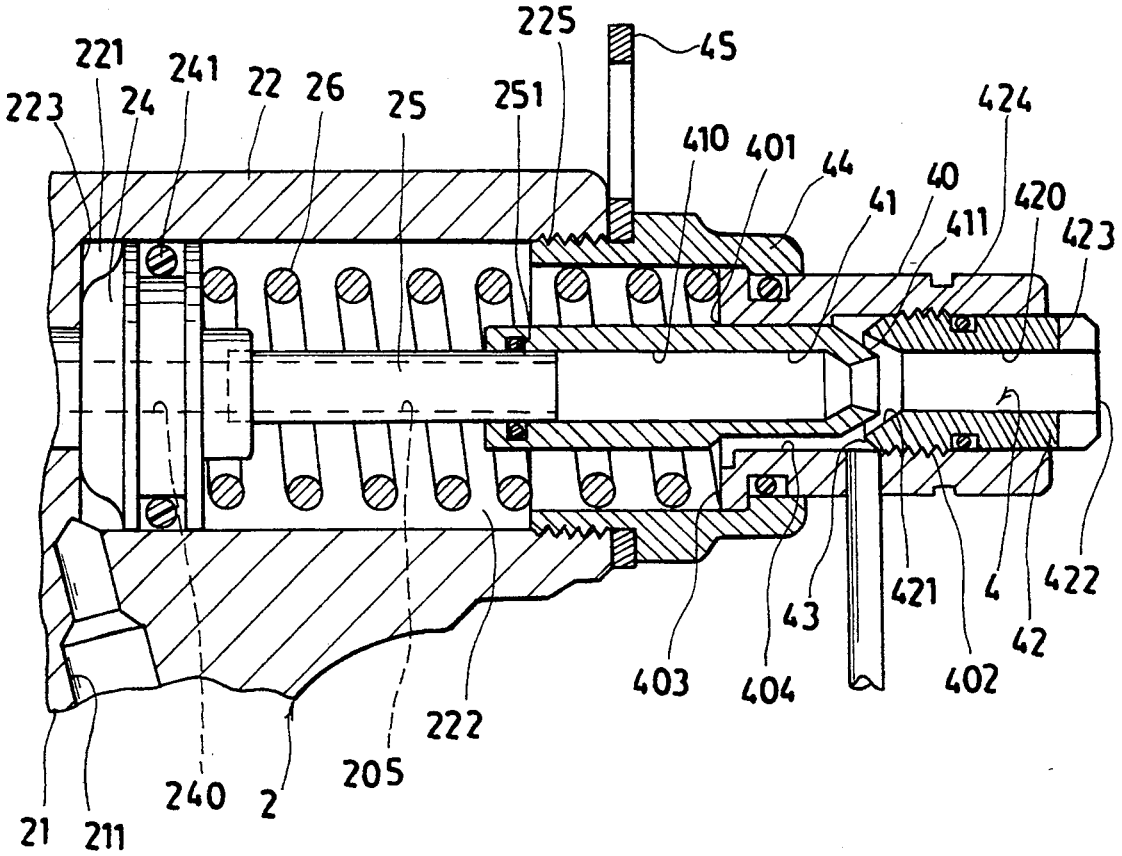
FIG. 3 is a partial enlarged illustration of a rear portion of the present invention.
Figure 4:
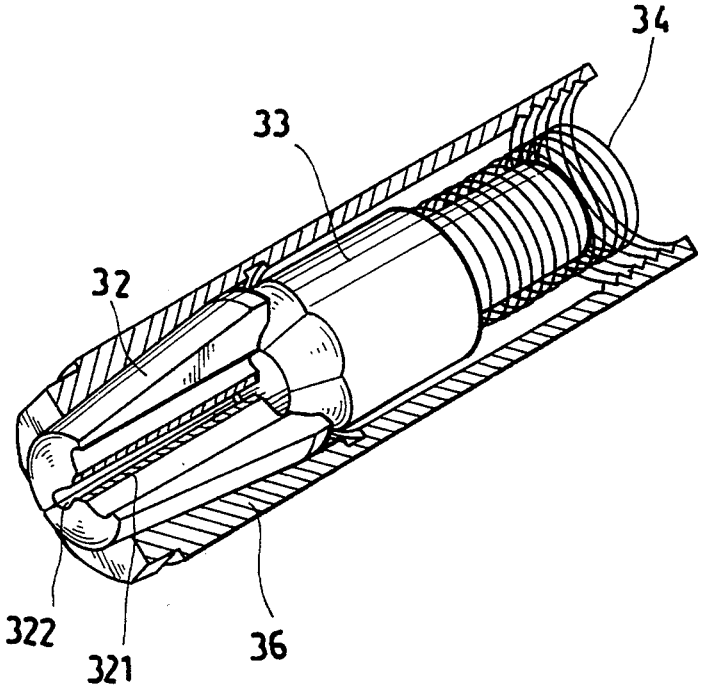
FIG. 4 is a partial cut-away illustration of the pulling head portion of the present invention.
Figure 5:
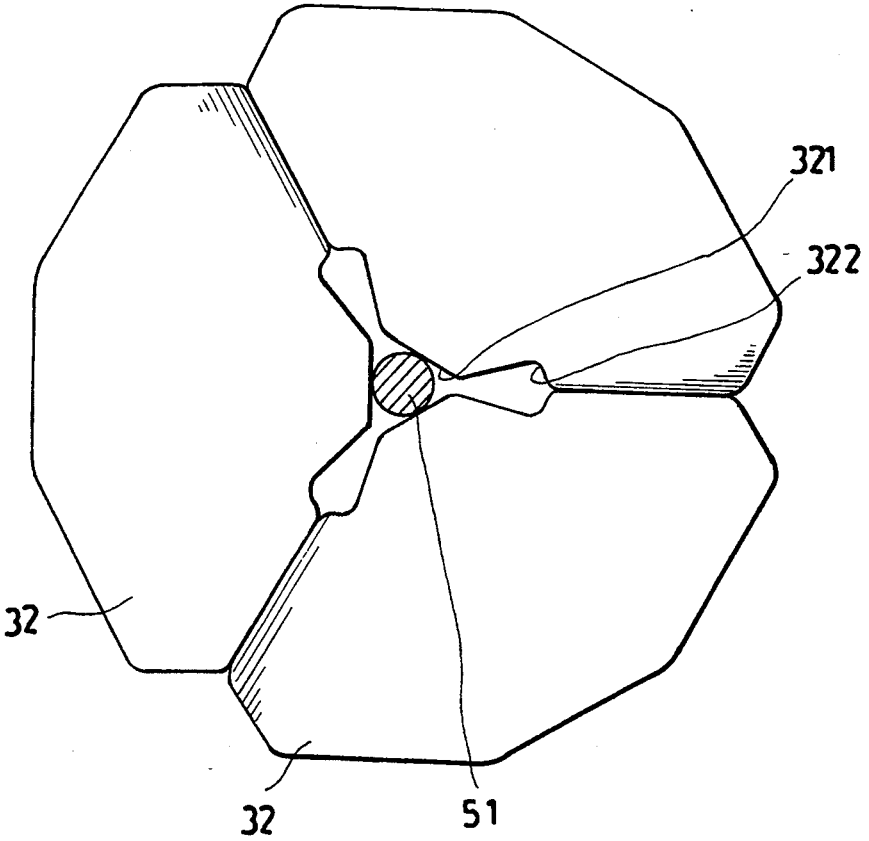
FIG. 5 is a front side view of the jaws of the present invention.

The pulling head portion 3 includes: a rivet holding screw (or nosepiece) 30 held in a front end portion of a front barrel 31 secured to a front end portion 224 of the turret hydraulic cylinder 22 having a central screw hole 302 formed through the screw (or nosepiece) 30 and a tip portion 301 protruding rearwardly beyond a front end portion 311 of the front barrel 31, a plurality of jaws 32 circumferentially forming an outer conical surface to be confined in a conical-shaped jaw sleeve 36 slidably held in the front barrel 31 and commonly defining a central chuck surface 321 for clamping a rivet mandrel 51 as shown in FIG. 5 and with the tip portion 301 of the rivet holding screw 30 rearwardly splitting the jaws 32 for free inserting a rivet mandrel 51 into the chuck surface 321 when the jaws 32 are retracted in the conical-shaped jaw sleeve 36 as retarded by the tip portion 301 of the screw 30, a jaw pusher 33 tensioned by a jaw restoring spring 34 retained on the front rod portion 232 of the upper plunger red 23 for normally urging the jaws 32 frontwardly ready for receiving and clamping the rivet mandrel 51 for setting the rivet 5 as shown in FIG. 2, and a hollow coupler 35 coupling the front rod portion 232 of the upper plunger rod 23 and the jaw sleeve 36 to be operatively retracted by the plunger 24 when boosted by a pressurized hydraulic oil when depressing the lever 14 for urging the piston 12 upwardly as shown in FIG. 7 (solid line) for setting the rivet 5.

The jaw pusher 33 is formed with a central through hole 331 for drafting spent mandrel 51 rearwardly.

Each jaw 32 has a radial aperture 322 radially notched in a radial side portion of each jaw 32 from the chuck surface 321 formed in a central portion of each jaw 32, each radial aperture 322 longitudinally formed through each jaw 3 and fluidically communicating with each central through hole passing through a central portion of the pulling head portion 3, the turret hydraulic cylinder 22, and the suction means 4 of this invention for purging and flushing any scraps or burrs prouduced when a rivet mandrel is clamped and pulled by a plurality of jaws 3.

The suction means 4 secured to a rear portion of the turret hydraulic cylinder 22 is longitudinally aligned with a longitudinal axis 100 formed in a center line of the pulling head portion 3 and the turret hydraulic cylinder 22, and includes: a front guide tube 41 secured in a front portion 401 of a coupling sleeve 40 mounted on a rear end portion 225 of the turret hydraulic cylinder 22 by a sealing cap 44 sealing the rear end portion of the turret hydraulic cylinder 22 and having a tapered conical portion 411 formed on a rear end of the front guide tube 41 tapered rearwardly and having a central front tube hole 410 formed therethrough, a rear guide tube 42 secured in a rear portion 402 of the coupling sleeve 40 and having converging funnel portion 421 formed on a front end portion of the rear guide tube 42 and separated from the tapered conical portion 411 of the front guide tube 41 with the conical throat portion 43 which is concentrically confined between the tapered conical portion 411 of the front guide tube 41 and the converging funnel portion 421 of the rear guide tube 42 for directing a compressed air stream therethrough, and a central. rear tube hole 420 formed through the rear guide tube 42 to be followed by a disposal outlet 422 formed on a rearmost end of the rear guide tube 42 for discharging a spent rivet mandrel 51 therefrom (on which a collection bag (not shown) can be connected for collecting the mandrels).

The suction means 4 includes: an accelerating air passage 404 formed between the throat portion 43 between the front guide tube 41 and the rear guide tube 42 through an outer tube surface of the front guide tube 41 and an inside surface of the coupling sleeve 40 for fluidically communicating a buffer chamber 222 formed in a rear portion of a second hydraulic oil chamber 221 of the turret hydraulic cylinder 22 with the throat portion 43 positioned between the front and rear guide tubes 41, 42.

The coupling sleeve 40 has a front shoulder portion 403 for retaining the restoring spring 26 for urging the plunger 24 frontwardly. The sealing cap 44 secures the sleeve 40 and a hanger 45 to the rear portion of the turret cylinder 22.

Figure 6:
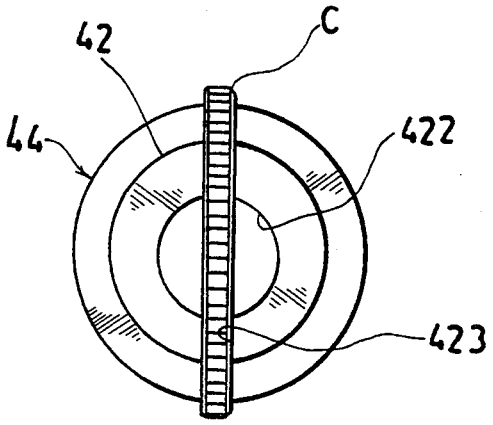
FIG. 6 is a rear side view of the suction means of the present invention.

The rear guide tube 42 includes a male-threaded portion 424 engageable with a female-threaded rear portion 402 in the coupling sleeve 40 and a rearmost end portion diametrically notched with a driving slot 423 therein as shown in FIG. 6 to be driven by a coin C or a driver for adjusting an opening (or for an on-off control) of the throat portion 43 by a rotational engagement between the male-threaded portion 424 of the rear guide tube 42 and the female-threaded portion 402 of the coupling sleeve 40.

The throat portion 43 is connected with a compressed-air conduit 71 supplied from a compressed air source 7 and may be built in the pneumatic body 1 and/or in the hydraulic body 2.

The front guide tube 41 has its central front tube hole 410 slidably engageable with a rear rod 25 secured to the plunger 24, said central front tube hole 410 fluidically communicating with a central through hole longitudinally formed through said pulling head portion 3, the plunger 24 and the rod 25 in the turret hydraulic cylinder 22 for drafting spent mandrel 51.

In operating the present invention, a rivet 5 to be set and fastened into the object 6 as shown in FIG. 2 is positioned to have its mandrel 51 inserted into the screw (nosepiece) 30 and the jaws 32, whereby upon an operation of the lever 14 to open the valve 10, the compressed air is directed from inlet 17 to pressurize the piston 12 in the pneumatic body 1 to pump the hydraulic oil in the hydraulic body 2 to boost the plunger 24 rearwardly to allow the spring 34 to urge the jaw pusher 33 and the jaws 32 to firmly clamp the mandrel 51 which is continuously pulled rearwardly by the jaw sleeve 36, the coupler 35, the rod 23 and the plunger 24 until being broken off from the flattened rivet as shown in FIG. 7. The lever 14 is released to vent air through holes 151, 152 to restore the plunger rod 23 and jaws 32 frontwardly until being retarded by the tip portion 301 of the screw 30 to loosen the jaws 32 (dotted line in FIG. 7), the compressed air stream enters the throat portion 43 will exert a Venturi effect to draft the spent mandrel 51 rearwardly through each central through hole in the pulling head portion 3, the turret cylinder 22 and the suction means 4 for a disposal treatment.

It is essentially noted that upon a rearward retraction of the plunger 24, the compressed air already entering the buffer chamber 222 will be suddenly compressed into the passage 404 as shown in FIG. 7 to accelerate the air velocity in the throat portion 43 for a very well initiation for sucking an air stream from the remote end, namely the jaws 32, to "flush" the burrs or scraps produced from the mandrel 51 as clamped and pulled by the jaws 32 for enhancing cleanliness therefor.

Meanwhile, the compressed air in the buffer chamber 222 in a rear portion of the turret cylinder 22 may also have the following advantages:

1. A positive pressure maintained in the buffer chamber 222 may provide a better sealing of the hydraulic system such as for sealing oil beyond the O-ring 241 of the plunger 24.

2. The compressed air in the buffer chamber 222 may help the spring 26 to restore the plunger 24 when releasing the lever 14.

3. It will serve as a shock absorber whenever breaking the mandrel on setting a rivet for a safer comfortable handling of the tool by a user.

4. The air in-and-out in the chamber 222 may outwardly dissipate heat produced by the movement of plunger 24 for cooling the cylinder 22 for ensuring a smooth operation of the present invention.

Accordingly, the present invention is superior to a conventional riveter with a single-hand operation and with an automatic drafting and removal of spent mandrels broken off from the set rivet due to a Venturi effect exerting in the suction means 4 of this invention to increase setting efficiency when operating the pneumatic/hydraulic riveter. The purging and flushing of scraps or burrs on the jaws 32 is effected by a stronger "drafting system" by the throat portion 43, the accelerating air passage 404, and the radial apertures 322 notched in the jaws 32 for cleaning the jaws for maintaining their goods working condition.

I claim:

1. A riveter comprising:

a pneumatic body having a pneumatic piston secured to a vertical plunger rod reciprocatively held in the pneumatic body and operatively pressurized by a compressed air entering the pneumatic body;

a hydraulic body having a handle portion connected on an upper portion of the pneumatic body and a turret hydraulic cylinder slightly inclinedly secured to a top portion of the handle portion having a plunger secured with an upper plunger rod and reciprocatively held in said turret hydraulic cylinder to be operatively pushed by a hydraulic oil when boosted by an upwardly moved pneumatic piston as urged by the compressed air;

a pulling head portion secured to a front portion of said turret hydraulic cylinder having a plurality of jaws for operatively clamping and pulling a mandrel of a set rivet as pulled by said plunger in said turret hydraulic cylinder; and a suction means secured to a rear portion of said turret hydraulic cylinder having a compressed air stream directed into said suction means for exerting a Venturi effect for drafting spent mandrel from the set rivet from said pulling head portion, said turret hydraulic cylinder to be discharged from the suction means for automatic drafting and removal of mandrel from rivet setting;

each said jaw having a radial aperture radially notched in a radial side portion of each said jaw from a chuck surface formed in a central portion of each said jaw, each said radial aperture longitudinally formed through each said jaw and fluidically communicating with a central through hole passing through a central portion of the pulling head portion, the turret hydraulic cylinder, and the suction means for purging and flushing any scraps produced when a rivet mandrel is clamped and pulled by said jaws; and said suction means longitudinally aligned with a longitudinal axis formed in a center of the pulling head portion and the turret hydraulic cylinder and including: a front guide tube secured in a front portion of a coupling sleeve mounted on a rear end portion of the turret hydraulic cylinder by a sealing cap sealing the rear end portion of the turret hydraulic cylinder and having a tapered conical portion formed on a rear end of the front guide tube tapered rearwardly and having a central front tube hole formed therethrough, a rear guide tube secured in a rear portion of the coupling sleeve and having a converging funnel portion formed on a front end portion of the rear guide tube and separated from the tapered conical portion of the front guide tube with a conical throat portion which is concentrically confined between the tapered conical portion of the front guide tube and the converging portion of the rear guide tube for directing a compressed air stream therethrough, and a central rear tube hole formed through said rear guide tube for discharging spent mandrel outwardly therethrough.

2. A riveter according to claim 1, wherein said suction means includes: an accelerating air passage communicating the throat portion defined between the front guide tube and the rear guide tube through an outer tube surface of the front guide tube and an inside surface of the coupling sleeve for fluidically communicating a buffer chamber formed in a rear portion of a hydraulic oil chamber in the turret hydraulic cylinder, with the throat portion defined between the front and rear guide tubes.

3. A riveter according to claim 2, wherein said rear guide tube includes a male-threaded portion engageable with a female-threaded rear portion in the coupling sleeve and a rearmost end portion diametrically notched with a driving slot therein to be driven by a coin for adjusting an opening of the throat portion by a rotational engagement between the male-threaded portion of said rear guide tube and the female-threaded portion of the coupling sleeve.

4. A riveter according to claim 1, wherein said throat portion is connected with a compressed-air conduit supplied from a compressed air source, said compresed-air conduit built in the pneumatic body and the hydraulic body.

5. A riveter according to claim 1, wherein said front guide tube has its central front tube hole slidably engageable with a rear rod secured to the plunger, said central front tube hole fluidically communicating with a central through hole longitudinally formed through said pulling head portion, the plunger and the turret hydraulic cylinder for drafting spent mandrel rearwardly outwardly.

* * * * *